US005984204A

United States Patent [19]

Harris

[11] Patent Number: 5,984,204

[45] **Date of Patent: *Nov. 16, 1999**

[54] SPRINKLER DEVICE FOR DISPERSING WATER OR OTHER LIQUID

[75] Inventor: Gerald Harris, Troon, United Kingdom

[73] Assignee: Gerry Harris, Troon, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/776,111

[22] PCT Filed: Jul. 4, 1995

[86] PCT No.: PCT/GB95/01585

§ 371 Date: Apr. 10, 1997

§ 102(e) Date: Apr. 10, 1997

[87] PCT Pub. No.: WO96/01153

PCT Pub. Date: Jan. 18, 1996

[30] Foreign Application Priority Data

| | | | |
|---|---|---|---|
| Jul. 6, 1994 | [GB] | United Kingdom | 9413652 |
| Oct. 5, 1994 | [GB] | United Kingdom | 9420105 |
| Nov. 5, 1994 | [GB] | United Kingdom | 9422385 |

[51] Int. Cl.[6] ..... B05B 3/04

[52] U.S. Cl. ..... 239/222.17; 239/382

[58] Field of Search ..... 239/222.11, 222.17, 239/222.19, 381, 382, 498, DIG. 1; 169/37

[56] References Cited

U.S. PATENT DOCUMENTS

| | | | |
|---|---|---|---|
| 1,993,011 | 3/1935 | Lindberg | 239/222.11 |
| 4,111,366 | 9/1978 | DeWitte | 239/222.17 |
| 4,391,102 | 7/1983 | Studhalter et al. | 60/649 |
| 4,560,108 | 12/1985 | Rubinstein | 239/222.17 |
| 4,817,869 | 4/1989 | Rubinstein | 239/222.17 |
| 4,901,920 | 2/1990 | Wollin | 239/2.2 |
| 5,224,652 | 7/1993 | Kessler | 239/222.17 |
| 5,338,495 | 8/1994 | Steiner et al. | 261/28 |
| 5,584,344 | 12/1996 | Meyer et al. | 169/37 |

FOREIGN PATENT DOCUMENTS

| | | |
|---|---|---|
| 2266455 | 10/1975 | France . |
| 620832 | 12/1980 | Switzerland . |
| 964808 | 7/1964 | United Kingdom . |

*Primary Examiner*—Andres Kashnikow
*Assistant Examiner*—Lisa Ann Douglas

[57] ABSTRACT

Water is supplied under pressure to a sprinkler device which produces one or more laminar flow jets. A high speed rotor intercepts only the boundary layer of the jets in a manner to impact violently upon the boundary layer. This produces a novel mode of operation in which water exits the jet along its length as vapour to form a mist of find droplets.

14 Claims, 8 Drawing Sheets

10
12
14
16
18
20
22
24
28
29
30
32
34
36
38
40
42

SPRINKLER DEVICE FOR DISPERSING WATER OR OTHER LIQUID

This invention relates to sprinkler devices for dispersing water or other liquids.

It is well known to use sprinkler devices to distribute water across a cultivated area. However, known sprinklers are not entirely satisfactory. Various types of known sprinklers suffer from one or more of disadvantages such as wind drift, excessive evaporation of water while airborne, leaving areas within the overall spray pattern unwatered, and damage to tender crops from water jet impact.

It is also known to use fixed systems of sprinklers for fire suppression, but to date no such system has coped satisfactorily with a wide range of fire risks including flammable liquids.

According to the present invention a sprinkler device comprises a liquid inlet and at least one liquid outlet joined by a flow passage, the flow passage being constructed to produce a substantially laminar fluid flow at the outlet to cause a substantially laminar flow liquid jet to issue from the outlet, and a rotor having blades positioned to intercept the boundary layer of said liquid jet.

The invention also provides systems for irrigation, fire suppression, snow generation and water purification.

Preferred features of the invention will be apparent from the following description and from the claims.

Embodiments of the invention will now be described, by way of example, with reference to the drawings, in which.

Figure 1:
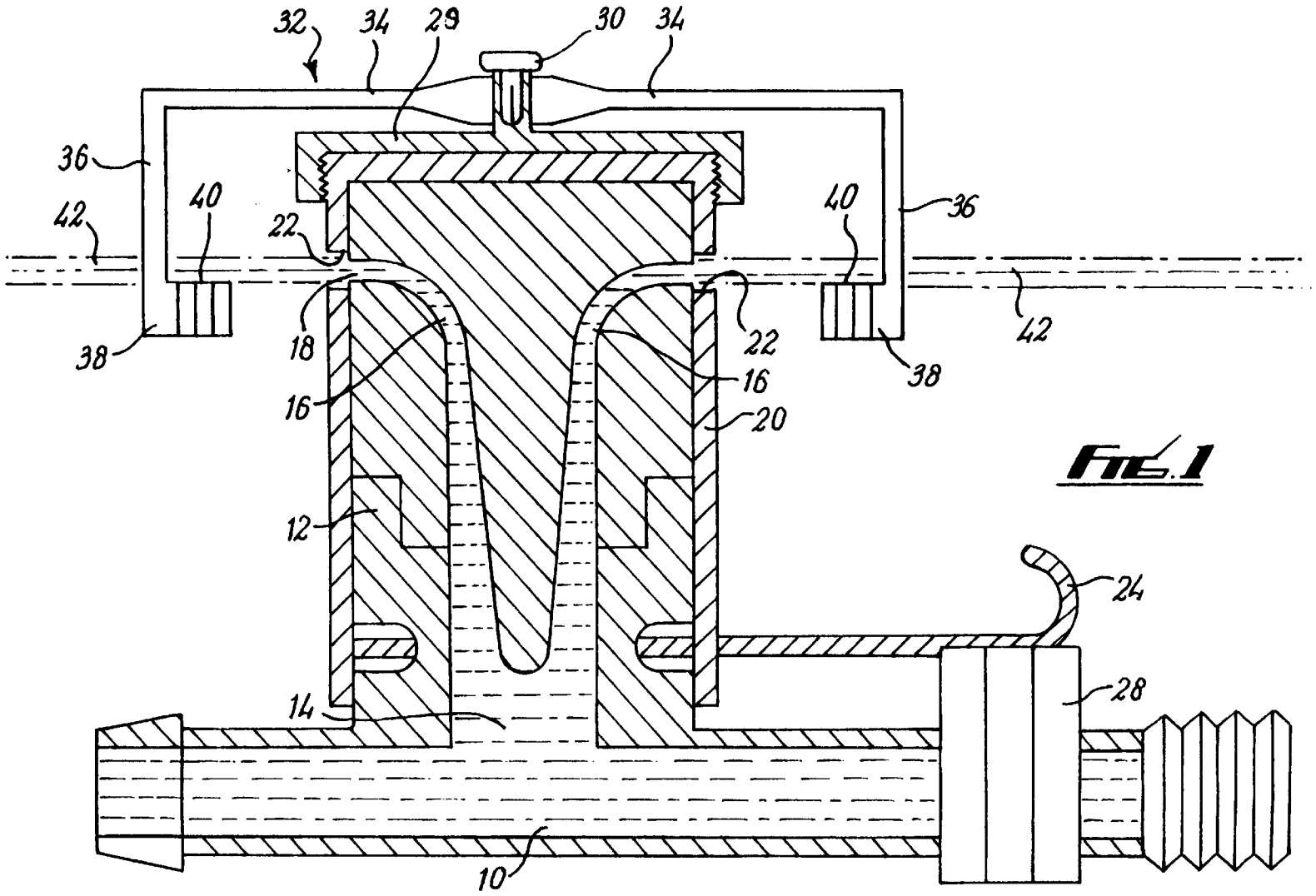
FIG. 1 is a cross-sectional side view of a sprinkler device forming a first embodiment of the invention.

Referring particularly to FIG. 1, a sprinkler device comprises a through conduit 10 for connection in a supply line of hose pipe or the like. A cylindrical housing 12 extends from the conduit 10 and defines a water channel 14 communicating with the conduit 10.

The water channel 14 divides into a number of channels 16 (suitably two, four or six in number) which are circumferentially equispaced around the housing 12. Each channel 16 converges and curves, as will be described in greater detail below, to terminate in an outlet 18.

Figure 2:
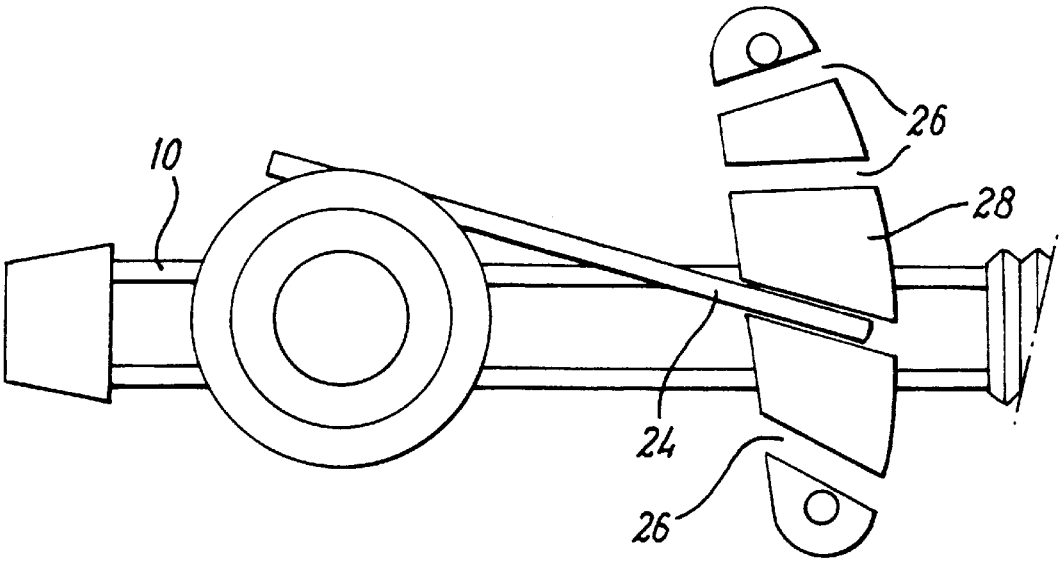
FIG. 2 is a plan view of the sprinkler device of FIG. 1.

A sleeve 20 is rotatably mounted on the housing 10. The sleeve 20 is provided with apertures 22 positioned such that rotation of the sleeve 20 relative to the housing opens or blocks selected ones of the outlets 18. As best seen in FIG. 2, the sleeve 20 may be provided with a spring arm 24 which can be manually positioned in a selected slot 26 of an arcuate block 28 secured to the conduit 10, to set the desired rotational position of the sleeve 20.

A block 28 is screwed to the top of the sleeve 20 and mounts an upstanding pin 30 which acts as a rotational bearing for a rotor assembly 32. The rotor assembly 32 comprises radial arms 34 (suitably two, four or six in number) each having an outer drop arm 36 carrying a blade 38. The blade 38 has a top edge 40 which is parallel to the path of water jets 42 exiting from the outlets 18, and the position of the top edge with respect to the water jets 42 can be adjusted by screwing the cap 28 in and out with respect to the sleeve 20.

Figure 3:
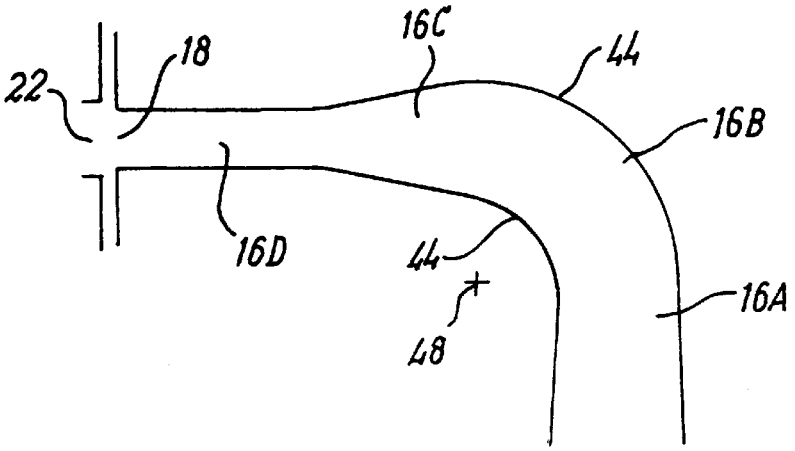
FIG. 3 illustrates in detail the geometry of part of the device.

An important feature of the present invention is that the water flow through the channels 14 and 16 to the outlets 18 is laminar. Referring now also to FIG. 3, each of the channels 16 has a vertically extending, converging section 16A, a transitional section 16B, a converging section 16C and a parallel exit section 16D. The transition section 16B is defined by surfaces 44 which are circular arcs about a point 48. This geometry causes water flowing from the conduit 10 to be accelerated while flowing to the outlet 18 in laminar flow. The sections 16C, 16D assist in restoring smooth laminar flow if any disturbance occurs in the transition section 16B.

A significant feature of the present invention is that the laminar flow jet 42 exiting each of the outlets 18 may be intercepted by the blades 38 such that the edge 40 just breaks through the surface of the water jet 42. The rotor assembly 32 may be driven by a suitable mechanical drive but preferably, as shown, it is driven by the water jets 42 acting on the rotor assembly turbine fashion, and the blades 38 are angled for this purpose. In a particularly preferred arrangement, the rotor speed is such that the blades 38 move at supersonic speed, typically with the rotor rotating at about 10,000 RPM, and the point approximate the boundary layer at which the blades 38 contact the jet 42 is spaced from the outlet 18, by a distance equivalent to about one-half of the jet diameter.

This combination of features produces a water pattern which is believed to be different in nature to any produced in the prior art. The water pattern consists of a jet of water which produces, along its entire length, water vapour and fine water particles of a nature very similar to a rain cloud. This in turn causes fine misty "rain" to fall on the ground in proximity to the point of production. This permits both a long jet giving a considerable throw and little affected by wind, and also a gentle precipitation onto the ground minimising impact damage.

An understanding of the precise physical phenomena underlying this mode of action is not necessary to achieve practical results. It is believed that the causes may be as follows. The laminar flow jet has an outer boundary layer with a relatively low speed and a high surface tension. When this outer boundary layer is impacted by the rotor blades with considerable force and typically with about 300,000 impacts per second, a relatively large amount of energy is transferred to a relatively small volume of water, causing the surface tension in the boundary layer to be destroyed and a quantity of water vapour to be produced. The water which is vaporised expands by a factor of about 1700, and a proportion of this water vapour is forced into and dissolves in the remainder of the water jet, producing internal pressure within the jet which, at the same time, has been deprived of a stable skin of high surface tension. The dissolved vapour pressure subsequently causes a mixture of gaseous water vapour and fine liquid particles to be precipitated from the water jet, substantially at a uniform rate along the path of the jet until, at the extremity of the jet path, no solid jet remains. The fine water particles produced in this manner typically have a diameter of about 5 microns.

Figure 4A:
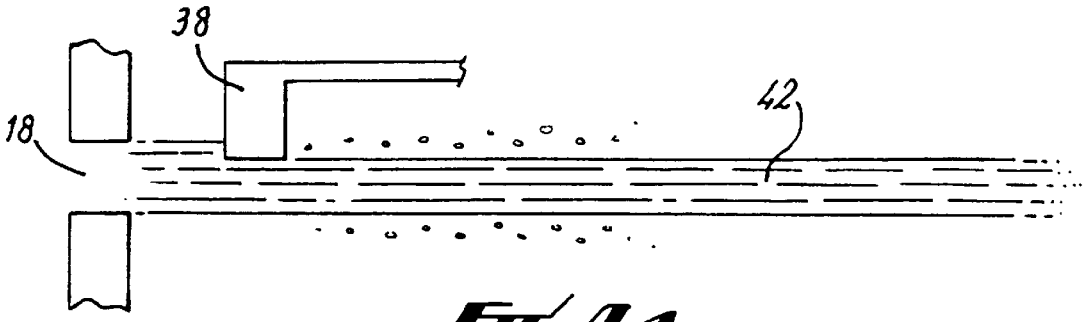
FIG. 4A, 4B and 4C illustrates different modes of operation of the device.

FIG. 4A shows a turbine blade 38 impacting a water jet 42 in the mode just described. The blade suitably enters the jet to a depth equivalent to between 5% and 15% of the jet diameter.

Figure 4B:
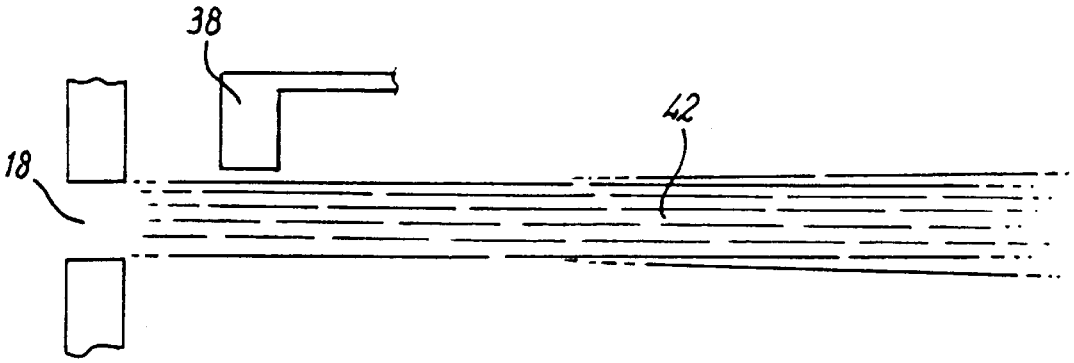
Figure 4C:
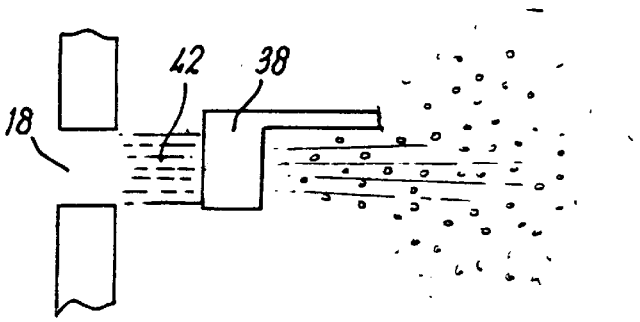

The relative position of the rotor assembly 32 may also be adjusted to allow a plain jet to be emitted, as in FIG. 4B, by removing the blade 38 from contact with the jet 42; or, as seen in FIG. 4C, to cause the blade 38 to intercept the jet substantially entirely which causes the jet to break up adjacent the device producing localised misting.

In one typical example of this embodiment, suitable for irrigation, the jet diameter is 17 mm and the water supply pressure 8 to 15 bar, producing a rotor speed of 8,000 to 10,000 rpm and a jet length of 30 to 40 meters.

Figure 5:
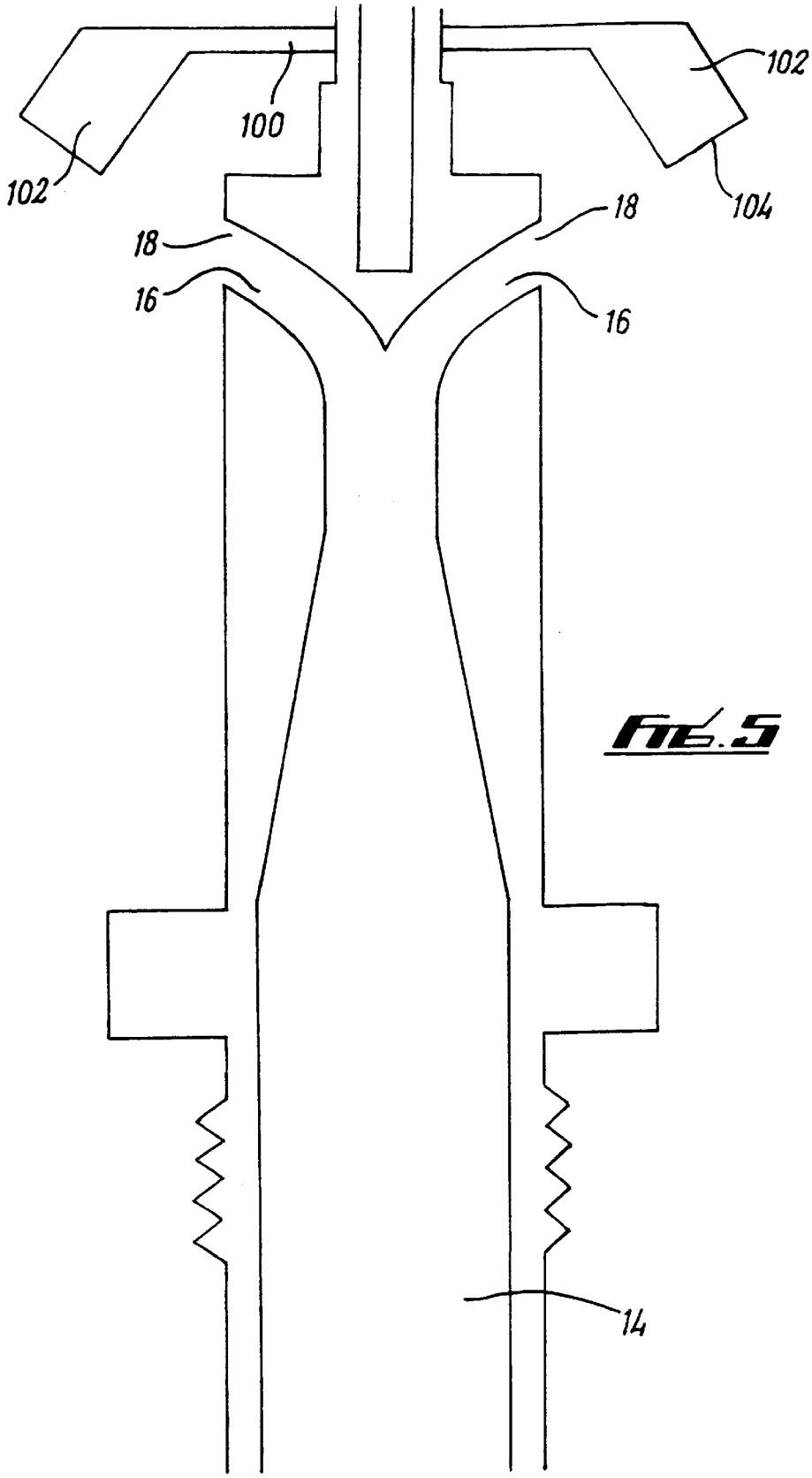
FIG. 5 is a schematic cross-section of a second embodiment.
Figure 6:
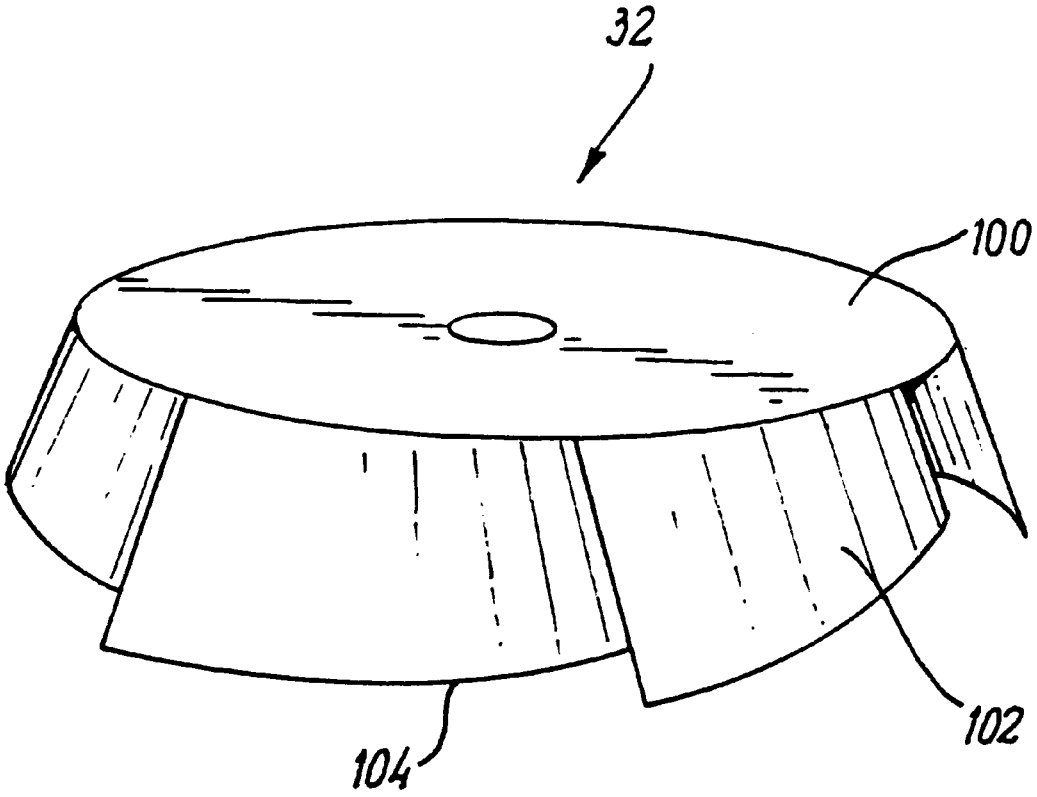
FIG. 6 is a perspective view of a rotor assembly used in the device of FIG. 5.

A second embodiment is schematically shown in FIGS. 5 and 6. This embodiment operates in a similar manner to that of FIGS. 1 to 3 and like parts are denoted by like references. In this embodiment, the outlets 18 are angled upwardly to achieve a greater throw, and the rotor assembly 32 is of a different form.

The rotor assembly 32 comprises a cap-shaped member which is bent and slit to form a rotor disc 100 integral with depending, angled rotor blades 102. The rotor blades 102 in this arrangement are above the water jets and the lower edges 104 of the blades 102 are arranged parallel with the jets.

Figure 7:
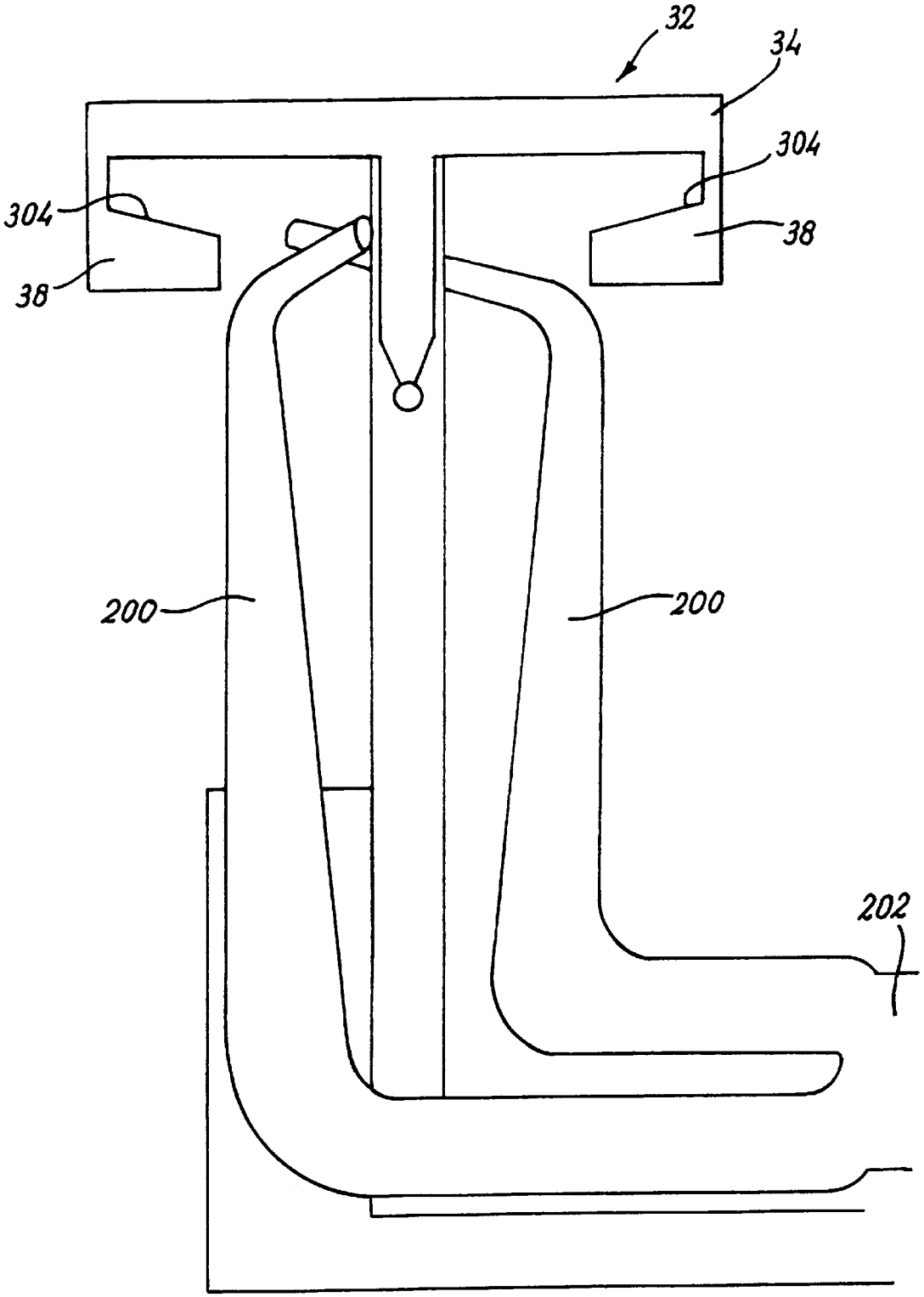
FIGS. 7 and 8 are schematic cross-sections of a third embodiment.
Figure 8:
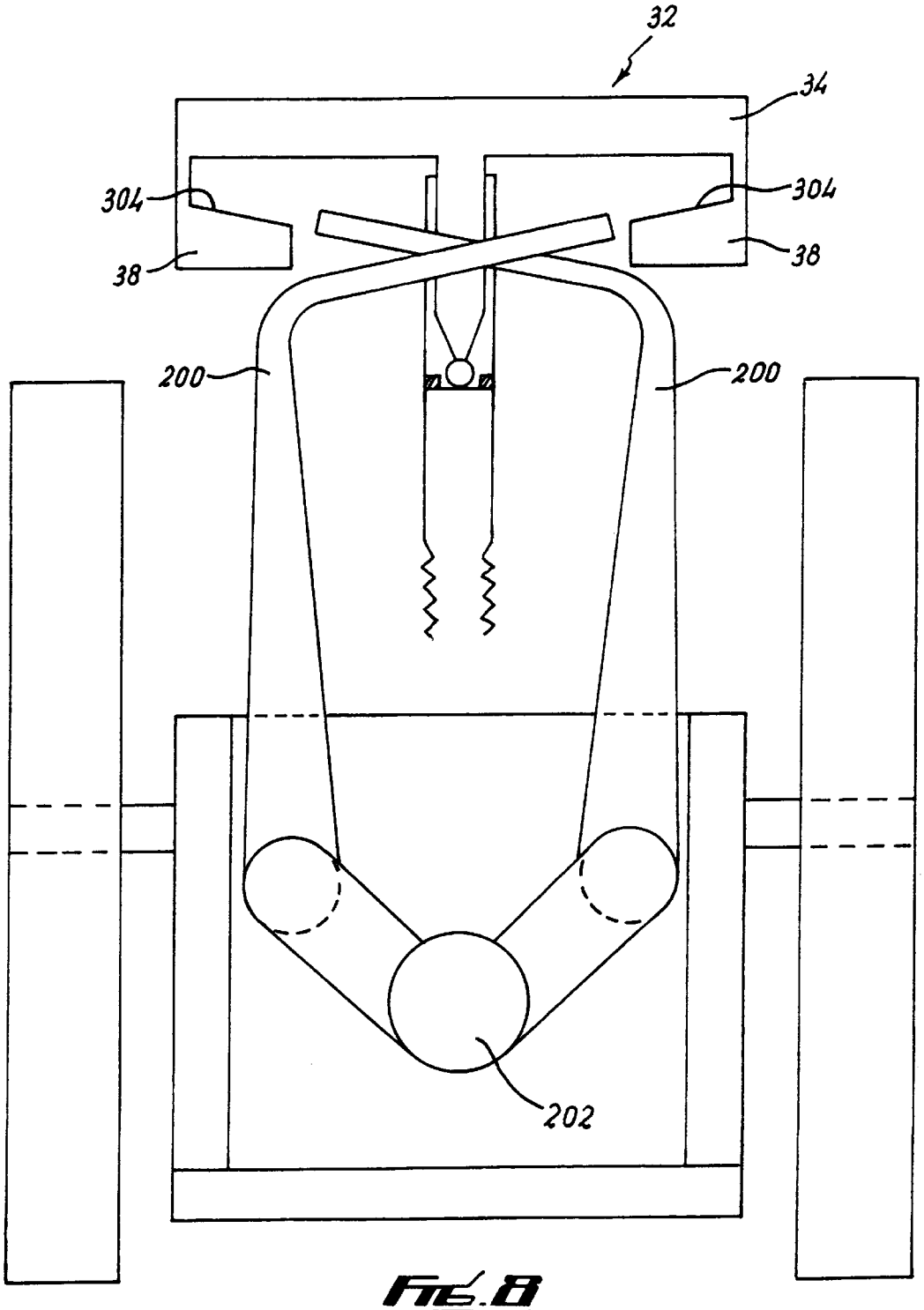

FIGS. 7 and 8 show a further embodiment in which angled jets are provided by separate flow pipes 200 connected to a supply conduit 202. The rotor assembly 32 in this case is similar to that of FIG. 1, but impact with the water jets is provided by top edges 304 of the blades 38.

Figure 9:
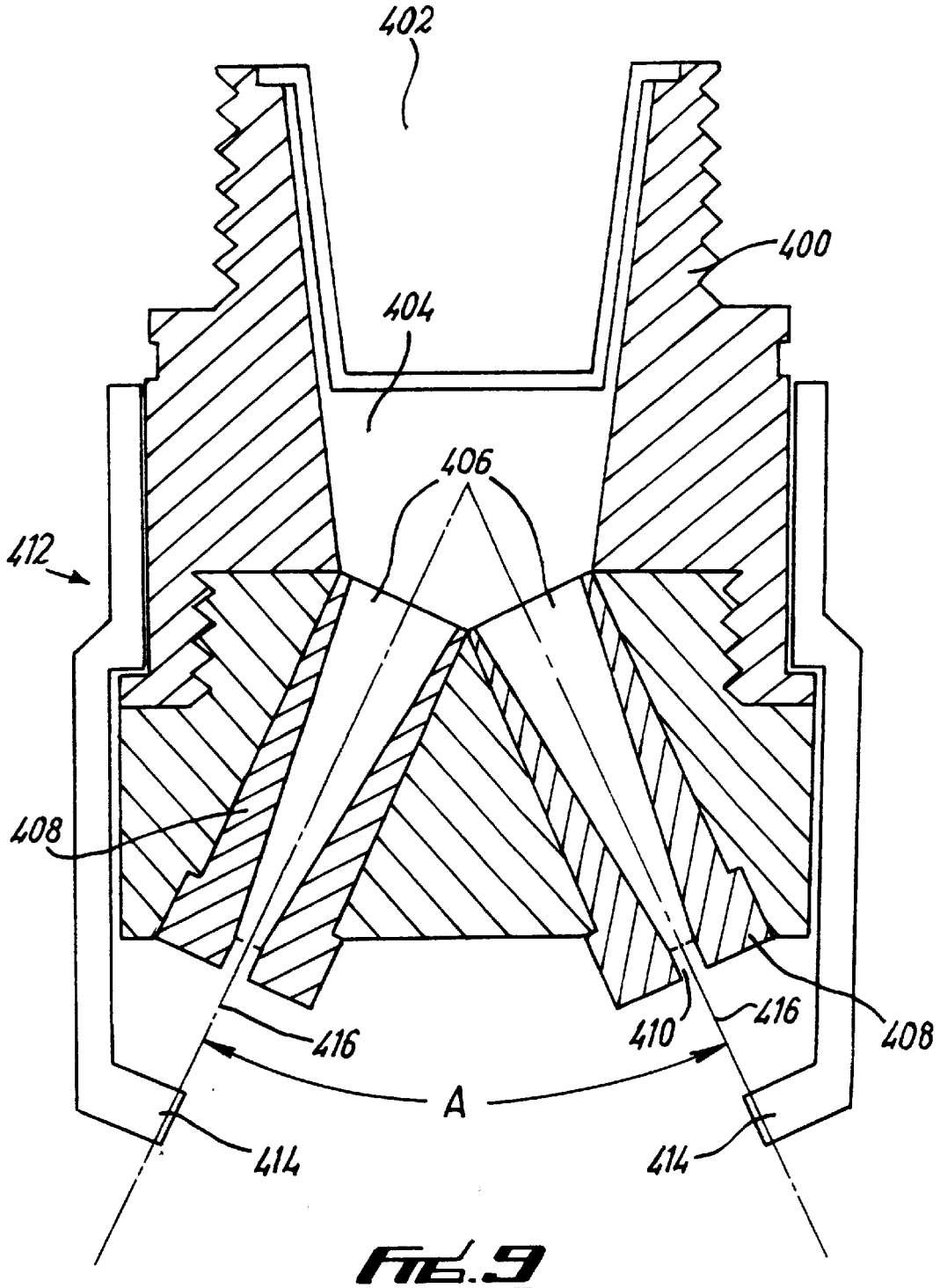
FIG. 9 is a cross-section of a further embodiment.

A further embodiment is illustrated in FIG. 9.

In this embodiment, a sprinkler device has a body 400 defining an inlet 402 for connection to a supply conduit. The inlet 402 communicates with a tapered flow passage 404, which divides into three tapered flow passages 406 defined by inserts 408 and terminating in equispaced outlets 410. A rotor assembly 412 is rotatably mounted on the exterior of the body 400, and has blades 414 positioned to intercept the water jets 416 produced by the outlets 410.

The water jets 416 are arranged in a conical formation with a cone angle A which may suitably be in the range 35°–50°. Although not shown in FIG. 9, the rotor assembly 412 may conveniently be mounted for adjustment axially of the body 400, thus allowing the depth of penetration of the rotor blades into the water jets to be adjusted.

This embodiment is particularly useful in fire suppression applications in which the relationship of rotor to jet and the supply pressure can be set to produce a dense, finely divided mist.

A typical example of this embodiment uses three nozzles of 0.6 to 1.00 mm diameter and a water supply pressure of 30 bar, with the rotor running at about 10,000 rpm. This produces a jet length of about 1 to 2 meters. Suitably, the sprinkler device is mounted vertically to produce a vertically downward jet; this has the effect of producing a curtain of water vapour and very fine water droplets which rapidly suppresses fire by cooling and by exclusion of oxygen.

It is believed that, when used in this mode with jet nozzles of less than two millimeters, three types of water droplets are produced. A very fine mist with particle sizes of the order of 5 microns is produced in the manner discussed above. In addition, two other types of droplet formation are believed to occur.

The central part of the jet, which is not impacted by the rotor, exhibits a tendency to form into globules at a distance from the jet which approximates to 1000 times the jet diameter. These globules typically have a size less than 1000 microns, and their formation is believed to be influenced by surface tension pressure compressing the outer surface or quasi-skin of the jet.

Additionally, droplets of intermediate size of approximately 450 microns are thought to be formed by physical shearing away of water from the jet by the rotor tips which create a window in the outer surface of the jet.

It will be appreciated that the embodiments of FIGS. 5 to 9 are arranged to operate only in the mode shown in FIG. 4*a*, that is the rotor is fixed with respect to the jet. These embodiments could, however, readily be modified to provide adjustment of the rotor.

The sprinkler device of the present invention may be used in applications other than irrigation and fire suppression.

In suitable conditions of atmospheric temperature and humidity, the sprinkler device may be used to generate snow, for example on ski slopes.

The device may also be used to treat salt or brackish water. Owing to the mode of operation described above, water is precipitated from the jet via a vapour phase to form very fine droplets. Thus if the sprinkler device is supplied with salt water, the mist produced in the initial stages is substantially pure water, leaving the continuing jet with an increased salt concentration.

This feature can be utilised to secure purified water by catching the early product of the jet in a trough or tunnel, and allowing the later stages of the jet to run to waste.

In general terms, the invention operates satisfactorily with supply pressures in the range of 2.5 to 40.00 bar and rotor speeds of 4,000 to 15,000 rpm, with best results achieved in the ranges 8 to 12 bar and 8,000 to 10,000 rpm. It is particularly convenient to use a plurality of jets arranged in a conical manner, since this facilitates precise adjustment of the rotor penetration by axial adjustment of the rotor. Typically, suitable cone angles are 15° to 50° for the fire suppression application, and 130° to 165° for the irrigation application.

I claim:

1. A sprinkler device comprising a body having: a liquid inlet; at least one liquid outlet; a flow passage connecting said liquid inlet to said liquid outlet, the flow passage being constructed to produce a substantially laminar fluid flow at said liquid outlet to cause a substantially laminar flow liquid jet to issue from said outlet; a rotor rotatably mounted on said body; a plurality of blades on said rotor, wherein said blades are positioned to intercept approximate the boundary layer of said liquid jet issuing from said liquid outlet.

2. A sprinkler device according to claim 1, in which the liquid inlet is joined to a plurality of outlets by respective flow passages each constructed to produce a substantially laminar flow at the respective outlet.

3. A sprinkler device according to claim 2, in which all of the liquid jets from said outlets are intercepted by a common rotor.

4. A sprinkler device according to claim 3 in which the jets are arranged conically about the rotor axis.

5. A sprinkler device according to claim 4, in which the cone angle is in the range 15° to 50°.

6. A sprinkler device according to claim 3, in which the cone angle is in the range 130° to 165°.

7. A sprinkler device according claim 1, in which the rotor is driven in rotation by the liquid jet or jets impinging thereon.

8. A sprinkler device according to claim 1, in which the flow passage tapers.

9. A sprinkler device according to claim 1, in which the rotor is fixed in position relative to said outlet that the rotor blades intercept the jet to a depth equal to 5% to 15% of the jet diameter.

10. A sprinkler device according to claim 1, in which the rotor is so positioned that the rotor blade intercepts the jet at a location spaced along the jet from said outlet by a distance substantially equal to 50% of the jet diameter.

11. An irrigation system comprising one or more sprinkler devices according to claim 1 connected to a source of pressurised water.

12. A fire suppression system comprising one or more sprinkler devices according to claim 1 connected to a source of pressurised water.

13. A system for generating snow comprising one or more sprinkler devices according to claim 1 connected to a source of pressurized water.

14. A system for desalinating salt or brackish water comprising one or more sprinkler devices according to claim 1 connected to a pressurised source of said water.

* * * * *